US006788906B2

(12) United States Patent
Suzuki et al.

(10) Patent No.: US 6,788,906 B2
(45) Date of Patent: Sep. 7, 2004

(54) FUSING DEVICE, HEAT GENERATING DEVICE, IMAGE FORMING DEVICE AND TEMPERATURE CONTROL METHOD

(75) Inventors: Yukio Suzuki, Iwatsuki (JP); Teruo Kaneko, Iwatsuki (JP); Naoki Honma, Iwatsuki (JP); Kunihiro Maie, Iwatsuki (JP); Kouji Tsutsumi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/388,736

(22) Filed: Mar. 17, 2003

(65) Prior Publication Data

US 2004/0067072 A1 Apr. 8, 2004

(30) Foreign Application Priority Data

Oct. 3, 2002 (JP) ..... 2002-291077

(51) Int. Cl.[7] ..... G03G 15/20

(52) U.S. Cl. ..... 399/69; 219/216; 219/470; 219/494; 399/328

(58) Field of Search ..... 399/69, 67, 320, 399/328, 334; 219/216, 255, 470, 490, 494, 509, 510

(56) References Cited

U.S. PATENT DOCUMENTS 6,490,423 B2 * 12/2002 Horobin et al. ..... 399/67
6,580,883 B2 * 6/2003 Suzumi ..... 399/69

FOREIGN PATENT DOCUMENTS

JP 05-346749 * 12/1993
JP A 11-233235 8/1999

* cited by examiner

*Primary Examiner*—Sophia S. Chen
(74) *Attorney, Agent, or Firm*—Oliff & Berridge, PLC

(57) ABSTRACT

Two temperature areas are set at a higher temperature side and at a lower temperature side of target temperature respectively. The power stage of the temperature areas at the higher temperature side is set to −1 and the power stage of the temperature areas at the lower temperature side is set to +1. Thus, a current value is varied little and generation of flicker can be reduced. Further, A temperature can be always converged into the target temperature. When a temperature is in a temperature area near to the target temperature, the power stage is maintained except for a case in which a temperature has passed through a temperature area other than this near temperature area and the target temperature area and enters this near temperature area for the first time. Thus, an amplitude of power can be suppressed.

20 Claims, 7 Drawing Sheets

CASE IN WHICH QUANTITY OF HEAT CONSUMED (QUANTITY OF HEAT TAKEN BY RECORDING SHEET) IS SMALL

O : OFF
L : LOW POWER
F : FULL POWER

SIMPLE TEMPERATURE CONTROL PATTERN

O:OFF
L:LOW POWER
F:FULL POWER

FUSING DEVICE, HEAT GENERATING DEVICE, IMAGE FORMING DEVICE AND TEMPERATURE CONTROL METHOD

BACKGROUND OF THE INVENTION

1. Field of the Invention

The present invention relates to a fusing device for use with an image forming device, which supplies toner to a latent image that is obtained by being exposed to light on a charged image carrier to form the latent image into an image and transfers a resultant toner image from the image carrier to a recording material, and for fixing the toner image on the recording material by applying a predetermined quantity of heat to the recording material, a heat generating device for making a heat generating member generate heat, an image forming device with the heat generating device and a temperature control method for controlling a temperature of the heat generating member.

2. Description of the Related Art

Conventionally, there has been provided a fusing device for performing a fusing treatment upon a recording material with a toner image being transferred thereto in an image forming device or the like. In the fusing device, a heat roller is heated by a heat source. Further, a recording material is conveyed while contacting the heat roller. Generation of heat from a lamp such as a halogen lamp built in the heat roller is usually utilized for the heat source. The heat source will be referred to as a fusing lamp hereinafter.

The fusing lamp is on-off controlled in order to maintain a surface temperature of the heat roller at a predetermined temperature. The fusing lamp becomes a factor of flicker caused by rush current generated when the fusing lamp is turned on and the heat roller starts to generate heat and when the fusing lamp is turned on during the control of the surface temperature of the heat roller.

In order to restrict the rush current of the fusing lamp, it is considered that a resistor is serially connected to the lamp when the fusing lamp starts to be lighted, so that the rush current is reduced by this resistor.

Nevertheless, the on-off control is frequently performed during the above-described temperature control. For this reason, in order to suppress repeatedly flowing the rush current, a resistor which can stand a large quantity of heat generation is required.

Especially a machine or the like such as a copying machine for large-scale drawings which is one of image forming devices requires a large quantity of power (800 W to 1,700 W). Thus, a resistor with a few hundreds watts of power is required to reduce a flicker and also, it becomes larger. The resistor itself generates a large quantity of heat and thus an atmosphere temperature within the machine becomes in an overheat state and the power is wastefully consumed. Thus, this atmosphere temperature and the consumption power may exceed their acceptable levels.

A prior art supposes that two lamps are serially placed in a heat roller and a number of lamps to be used is appropriately selected. (Japanese Patent Application Laid-Open (JP-A) No. 11-233235).

Japanese Patent Application Laid-Open (JP-A) No. 11-233235 describes only the case of warm-up and does not describe in detail when the two lamps should be selected in order to reduce a flicker and an on-off control of the two lamps. Thus, suppression of rush current at a time when a device starts to be operated may be expected to some extent (which is similar to a resistor inserting method) Nevertheless, Japanese Patent Application Laid-Open (JP-A) No. 11-233235 does not disclose a control method for suppressing a flicker generated during frequent on-off control in the operation of the device in a acceptable range.

SUMMARY OF THE INVENTION

The present invention is developed in light of the above-described facts and an object of the invention is to obtain a fusing device that, when a fusing treatment is performed by using a heat source with large power, is able to suppress a flicker generated during on-off control for maintaining a set temperature for the fusing treatment in an acceptable range.

Another object of the invention is to obtain a heat generating device and an image forming device that are able to suppress a flicker generated during on-off control for maintaining a set temperature of heat generating member in an acceptable range.

In addition to the aforementioned objects, yet another object of the invention is to obtain a temperature control method in which drawbacks of temperature control caused by a plurality of lamps being used at the same time (the heat generating member may be converged into two temperature levels at a time of the temperature control) can be solved and the heat generating member can be converged into a single set temperature.

A fusing device of the invention is for use with an image forming device, which supplies toner to a latent image that is obtained by being exposed to light on a charged image carrier to form the latent image into an image and transfers a resultant toner image from the image carrier to a recording material, and for fixing the toner image on the recording material by applying a predetermined quantity of heat to the recording material. The fusing device comprises: a heat roller which forms a portion of a conveyance path for the recording material and nips the recording material; a plurality of lamps which are accommodated within the heat roller and are connected in serial with each other and serve as heat sources; a switching component which classifies the plurality of lamps into at least a main lamp group and a sub-lamp group and is able to switch between application of electricity to the main lamp group and the sub-lamp group, application of electricity to only the main lamp group and application of electricity to neither the main lamp group nor the sub-lamp group; and a temperature control component which controls a temperature of the heat roller by controlling on or off switching of the plurality of lamps to control the power stage of the plurality of lamps with at least stages of off, low power and full power.

According to the fusing device of the invention, when the temperature of the heat roller can be controlled by one lamp group, a large quantity of power is required. For this reason, a rush current is generated when the one lamp group is switched on. Temperature control is performed by on-off control. Thus, a flicker is generated at a time of start of operation of the device as well as during operation of device.

Then, when switching on the lamp, the sub-lamp group which is connected in serial with the main lamp group is also switched on at the same time. For example, when the two lamp groups with the same power are serially connected with each other and turned on at the same time, a current flowing therethrough is half of current flowing when only one lamp group is lighted.

More specifically, when 500 W (100 V of rating) of lamp is lighted at 100 V, 5 A of current flows therethrough. Thus, a resistance R of this lamp is 20Ω ($W=I^2R$).

On the other hand, when 500 W (100 V of rating) of two lamps are serially connected with each other and lighted at 100 V, a total resistance R of these lamps is 20Ω+20Ω=40Ω and thus 2.5 A of current flows therethrough (each of the lamp groups is lighted at 125 W).

In this way, a current can be suppressed. Thus, a rush current can be also reduced.

According to the fusing device of the invention, an added lamp for reducing a flicker is also utilized as a heat source. According to the temperature control component, three power stages, i.e., off, low power and full power are set so that temperature control is performed. Thanks to such temperature control, an overshoot can be reduced and the number of on-off switching can be also reduced. For example, when two lamps are connected in serial with each other, at a time of device being turned on, the power stage is in a low power state that two lamps are lighted at the same time. If desired, the power stage may be switched to an off state or a full power state that only one lamp is lighted.

A temperature control method of a first aspect of the invention is for controlling a temperature of a heat generating member by making the heat generating member generate heat in a plurality of power stages. the temperature control method of the first aspect comprises the steps of: setting a plurality of temperature areas for the heat generating member and setting a number of power stage to be increased/decreased for each of the temperature areas; detecting the temperature of the heat generating member; and increasing/decreasing, as necessary, the power stage by the number of power stage to be increased/decreased, which is set for the temperature area to which the temperature of the heat generating member belongs.

According to the temperature control method of the first aspect, there is provided, e.g., a temperature control method for controlling a temperature on a surface of a heat roller by selecting three power stages. A target temperature area for the heat roller is set in advance. Then, temperature areas are set at a higher temperature side of the target temperature area and at a lower temperature side of the target temperature area with the target temperature area at the middle of them. A current temperature on the surface of the heat roller is detected and it is determined to which temperature area the detected temperature belongs. In the determined temperature area, the power stage is increased/decreased by one stage. Thus, variation in the temperature on the surface of the heat roller is balanced on a basis of a quantity of heat transmitted to a recording material and it is controlled so that the detected temperature is converged into the target temperature area.

For example, lamps serving as heat sources for fusing are classified into two groups (hereinafter, each lamp group will be described as one lamp). Off, low power (two lamps are lighted) and full power (one lamp is lighted) are set as power stages (since the lamps are connected in serial with each other, a power generated when one lamp is lighted is larger than that generated when two lamps are lighted). In this case, according to a general temperature control, the power stage is uniquely set in proportion to the difference between the temperature on the surface of the heat roller detected by a temperature sensor and a target temperature and then temperature control is performed. Namely, two temperature areas are set at the higher temperature side of the target temperature and at the lower temperature side of the target temperature, respectively with the target temperature at the middle of them. The power stage is set in advance for each of the temperature areas.

Regardless of conditions (rate of change), the temperature on the surface of the heat roller enters these temperature areas and the power stage is switched to the power stage which is set in advance for these four temperature areas.

According to such temperature control, however, a rate of change in temperature of the heat roller relating to a quantity of heat taken by (transmitted to) the recording material is not considered.

Suppose that an initial temperature is in a second temperature area from the target temperature toward the lower temperature side and thus heating control is performed at full power (conditions).

If a quantity of heat taken is large, the temperature reaches a first temperature area from the target temperature toward the lower temperature side and the power stage is in a low power state. Since a quantity of heat taken is larger than that applied in a low power state of the power stage at this time, the temperature is not increased. Thus, an actual temperature is converged into the boundary between the first temperature area from the target temperature toward the lower temperature side and the second temperature area from the target temperature toward the lower temperature side (see solid line shown in FIG. 7).

On the other hand, if a quantity of heat taken is small under the same conditions as the aforementioned, the temperature exceeds the target temperature and reaches a second temperature area from the target temperature toward the higher temperature side. Thereafter, the power stage is in an off state and the temperature starts to be decreased. Then, in a first temperature area from the target temperature toward the higher temperature side, heating control is performed in a low power state. A quantity of heat applied in a low power state of the power stage exceeds a quantity of heat taken. For this reason, an actual temperature is converged into the boundary between the first temperature area from the target temperature toward the higher temperature side and the second temperature area from the target temperature toward the higher temperature side (see chain line shown in FIG. 7).

According to the temperature control method of the first aspect, for example, the temperature area is set at the higher temperature side of the target temperature and at the lower temperature side of the target temperature, respectively with the target temperature at the middle of them. In the respective temperature areas at the higher temperature side and at the lower temperature side, the power stage is set to be increased/decreased from the current power stage by one stage. Then, the heat roller is heated in a power stage which is increased/decreased by one stage on a basis of temperature area determined by a detected temperature on the surface of the heat roller.

Namely, the power stage is not determined as an absolute power with respect to each of the temperature areas but controlled so as to be increased/decreased by one stage from a current power stage. Accordingly, when the power stage is to be increased in the same temperature area, for example, the power stage is switched to a low power state if the current power stage is in an off state, and the power stage is switched to a full power state if the current power stage is in a low power state.

Because of such relative control, an actual temperature is converged into a vicinity of target temperature regardless of a quantity of heat taken by the recording material. Thus, stable temperature control can be performed.

A temperature control method of a second aspect of the invention, according to the temperature control method of the first aspect, wherein when the temperature area to which the temperature of the heat generating member belongs is a non-target temperature area adjacent to the target temperature area, the power stage is increased/decreased only in a case in which the temperature of the heat generating member has passed through a temperature area other than said adjacent non-target temperature area and the target temperature area and then enters said adjacent non-target temperature area for the first time.

According to the temperature control method of the second aspect, for example, the temperature areas are classified into two temperature areas at the higher temperature side of the target temperature area and at the lower temperature side of the target temperature area, respectively. When the determined temperature area is a temperature area near to the target temperature area, the power stage is maintained except for a case in which the surface temperature of the heat roller has passed through a temperature area other than said near temperature area and the target temperature area and then enters said near temperature area for the first time.

As described above, suppose that the temperature areas are classified into two temperature areas at the higher temperature side and at the lower temperature side, respectively. When the determined temperature area is a temperature area near to the target temperature area, the power stage is maintained except for a case in which the surface temperature of the heat roller has passed through a temperature area other than said near temperature area and the target temperature area and then enters said near temperature area for the first time. As a result, an amplitude of power can be reduced.

A heat generating device of the invention comprises: a heat generating member which includes a plurality of heat sources connected in serial with each other and generates heat by application of electricity to the heat source; and a heat generation control component which controls a state of application of electricity to the plurality of heat sources and makes the heat generating member generate heat in at least three power stages.

An image forming device of the invention comprises the heat generating device according of the invention. The image forming device is for supplying toner to a latent image that was obtained by being exposed to light on a charged image carrier to form toner image onto the image carrier and for transferring the toner image from the image carrier to the heated member, wherein the toner image is fixed onto a heated member by the heat generating member heating the heated member.

DESCRIPTION OF THE PREFERRED EMBODIMENTS

Figure 1:
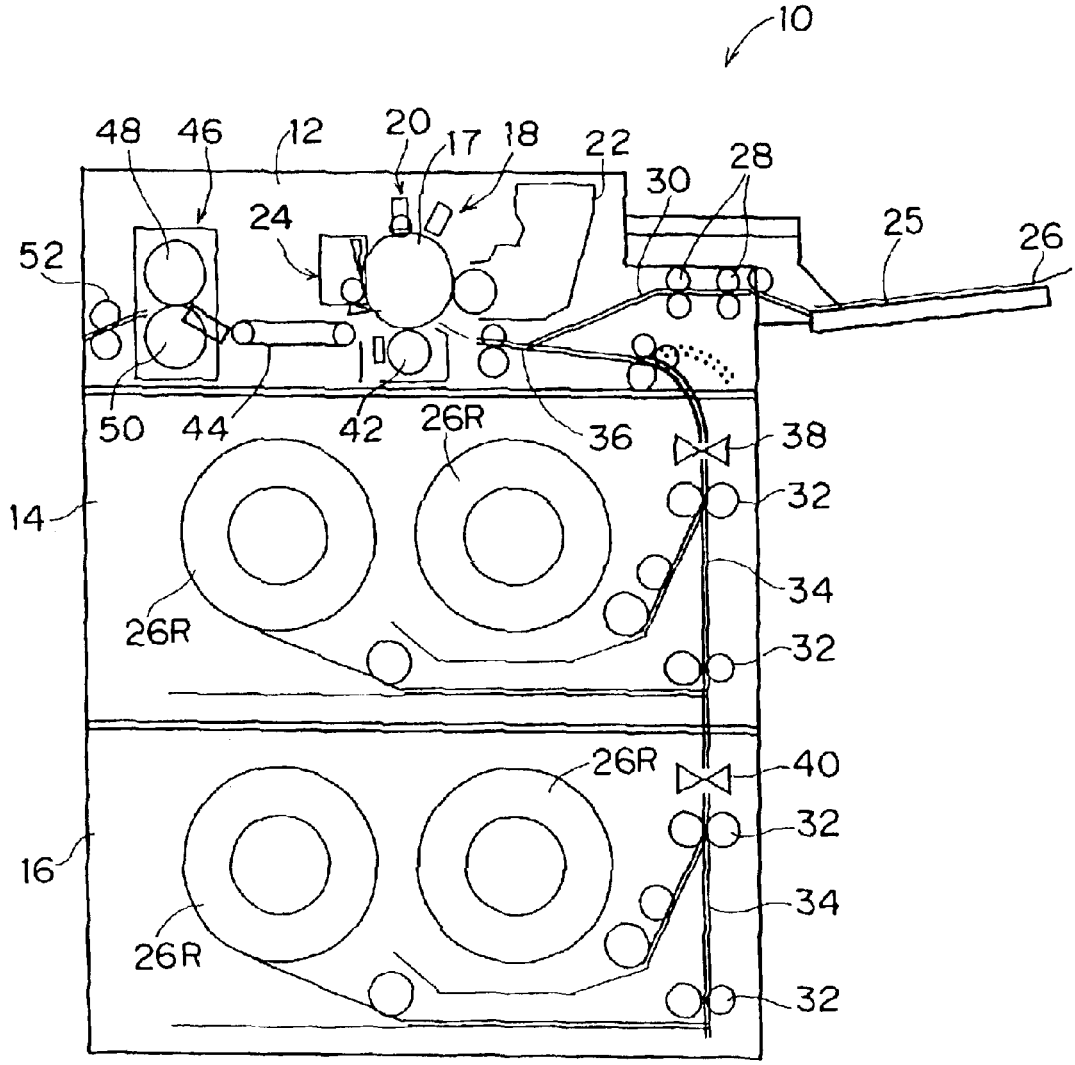
FIG. 1 is a schematic structural view of image forming device according to an embodiment of the present invention.

FIG. 1 shows the structure of image forming device 10 according to an embodiment of the present invention.

A main unit 12 is disposed at the upper portion of the image forming device 10. Roll paper supplying devices 14 and 16 are disposed in two stages under the main unit 12.

A photosensitive drum 17 serving as an image carrier is provided within the main unit 12. A scanning optical system 18, a charging device 20, a development device 22 and a peeling unit 24 are provided around the photosensitive drum 17.

An insertion tray 25 is provided so as to be protruded from a right end portion of the main unit 12 shown in FIG. 1. A recording material 26 that serves as a heated member and is manually inserted from this insertion tray 25 is fed within the main unit 12 along a conveyance path structured by roller pairs 28, a guide plate 30 and the like. Two roll papers 26R are loaded into the roll paper supplying devices 14 and 16, respectively. A recording material 26 supplied from these roll papers 26R is fed within the main unit 12 along a conveyance path structured by roller pairs 32, guide plates 34 and the like. The conveyance path from the roll paper supplying devices 14 and 16 joins the conveyance path from the insertion tray 25 at the upstream side of the photosensitive drum 17.

A joined conveyance path 36 guides and conveys the recording material 26 so that it is in generally planar state. The conveyance path 36 makes the recording material 26 pass along the direction of lower tangent of the photosensitive drum 17. The recording material 26 supplied from the roll paper supplying devices 14 and 16 is cut in a predetermined length by cutters 38 and 40 immediately before fed into the main unit 12. Then, the cut recording material 26 is fed into the main unit 12.

The scanning optical system 18 irradiates LED light on a basis of image output data onto the photosensitive drum 17. As a result, the scanning optical system 18 outputs an image onto the recording material 26 which is conveyed while being nipped between the photosensitive drum 17 and a transfer roll 42.

By the image recording material 26 being nipped between the photosensitive drum 17 and the transfer roll 42, a toner image is transferred to the image recording material 26. Further, the recording material 26 is fed via a conveyance belt 44 to a fusing device 46 serving as a heat generating device.

The fusing device 46 is provided with a pair of rollers 48 and 50. One of the pair of rollers 48 and 50 (in this embodiment, a roller opposing an upper surface of the recording material 26 (a surface with a toner image being formed thereon)) is a heat roller 48 serving as a heat generating member.

Figure 2:
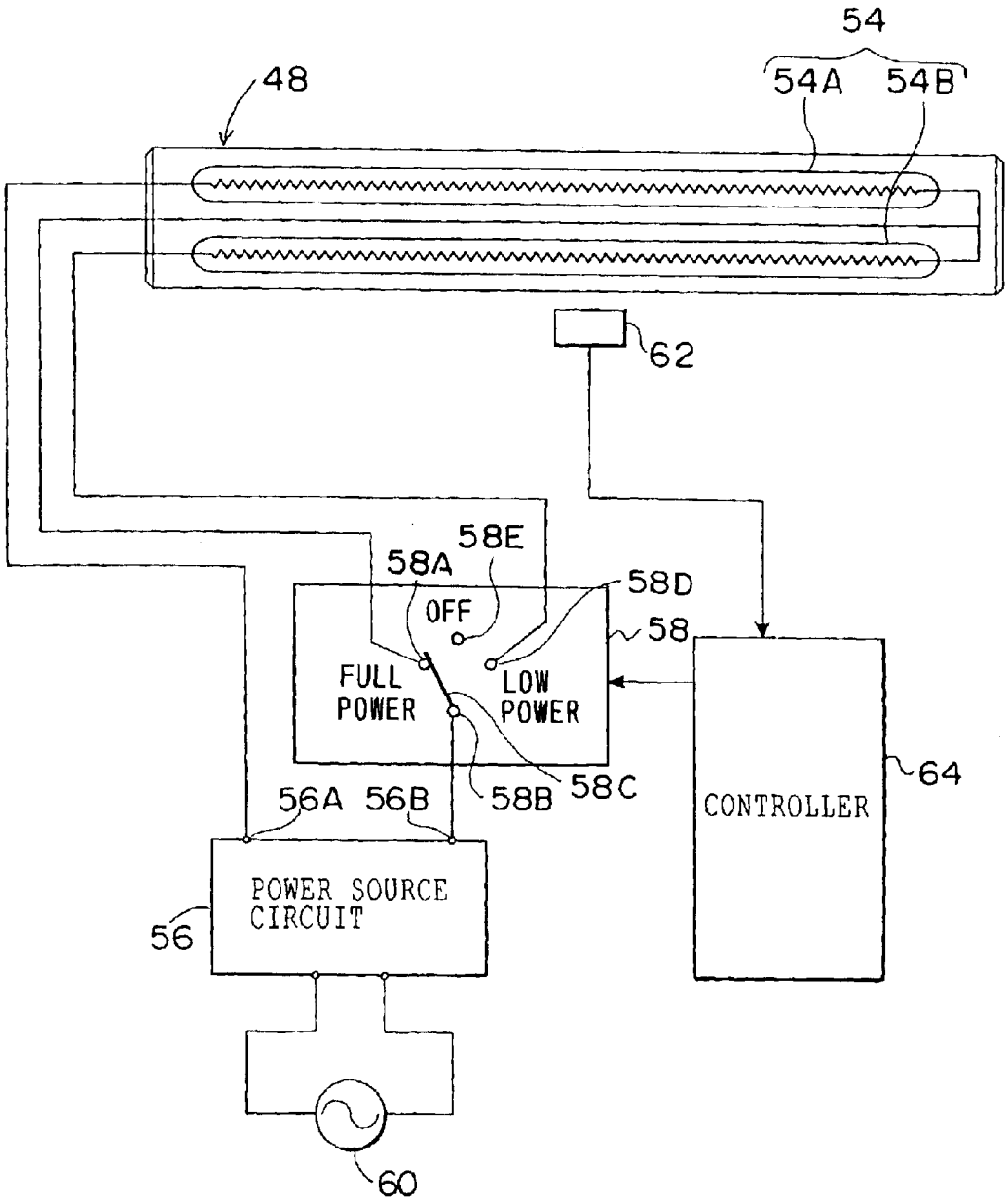
FIG. 2 is a control block diagram illustrating a control system of halogen lamps serving as heat sources provided within a heat roller in a fusing device.

As shown in FIG. 2, a pair of halogen lamps 54 serving as heat sources and lamps is accommodated within the heat roller 48. The surface of the heat roller 48 is heated by heat generated when the halogen lamps 54 are lighted. The recording material 26 is nipped between the heat roller 48 and the roller 50 opposing the heat roller 48 and then conveyed. In this way, the recording material 26 is heated and pressed, so that toner is fixed to the recording material 26.

The recording material 26 which has passed through the fusing device 46 is nipped by a conveyance roller pair 52. Then, the recording material 26 is outputted outside of the image forming device 10.

FIG. 2 shows a control system of the halogen lamps 54 serving as the heat sources that is provided within the heat roller 48.

The pair of halogen lamps 54 is accommodated within the heat roller 48. The pair of halogen lamps 54 are provided in parallel with each other so as to be generally parallel to an axis of the heat roller 48. The halogen lamp 54 shown on the upper side in FIG. 2 serves as a main lamp 54A (the lamp of main lamp group). The halogen lamp 54 shown on the lower side in FIG. 2 serves as a sub-lamp 54B (the lamp of sub-lamp group).

One end portion (left end portion in FIG. 2) of the main lamp 54A is connected to one output end 56A of power source circuit 56. The other end portion (right end portion in FIG. 2) of the main lamp 54A is connected to a first contact 58A of switching circuit 58 serving as a switching component which structures a heat generation control component. A common terminal 58B of the switching circuit 58 is connected to the other output terminal 56B of the power source circuit 56. Thus, when a contact 58C of the switching circuit 58 is switched to the first contact 58A, a predetermined quantity of power is supplied from an alternating-current power source 60 via the power source circuit 56 to the main lamp 54A.

The main lamp 54A has 1,700 W (240 V of rating) of power. For this reason, by AC 100 V of voltage being applied from the power source circuit 56 to the main lamp 54A, the main lamp 54A is lighted at 1,700 W of consumption power (about 7.1 A of current value) (FULL POWER).

One end portion (a left end portion in FIG. 2) of the sub-lamp 54B provided in parallel to the main lamp 54A is connected to a second contact 58D of the switching circuit 58. The other end portion (a right end portion in FIG. 2) of the sub-lamp 54B is connected to the other end portion (the right end portion in FIG. 2) of the main lamp 54A. Thereby, when the contact 58C of the switching circuit 58 is switched to the second contact 58D, the main lamp 54A and the sub-lamp 54B are connected in serial with each other so as to structure a circuit. Then, a predetermined quantity of power is supplied from the alternating-current power source 60 via the power source circuit 56 to the main lamp 54A and the sub-lamp 54B.

The sub-lamp 54B has 850 W of power (240 V of rating). For this reason, by AC 240 V of voltage being applied from the power source circuit 56 to the main lamp 54A and the sub-lamp 54B connected in serial, the main lamp 54A is lighted at about 190 W of consumption power and the sub-lamp 54B is lighted at about 380 W of consumption power (about 2.4 A of current value) (LOW POWER).

Open third contact 58E is placed between the first contact 58A and the second contact 58D. When the contact 58C is switched to this third contact 58E, the halogen lamp 54 is turned off (OFF).

According to this embodiment, three power stages of OFF, LOW POWER and FULL POWER can be selectively set.

A temperature sensor 62 serving as a detection component is mounted in a vicinity of the surface of the heat roller 48. A signal line of the temperature sensor 62 is connected to a controller 64 serving as a temperature control component which structures the heat generation control component. The controller 64 is connected to the switching circuit 58. Thereby, the controller 64 sends a signal for instructing to switch the contact 58C to the switching circuit 58.

In the above-described control system for the halogen lamps 54, a switching signal is sent to the switching circuit 58 on a basis of the difference in temperature between a temperature on the surface of the heat roller 48 sent by a signal from the temperature sensor 62 and a target temperature stored in advance in a memory of the controller 64. Then, the control system for the halogen lamps 54 manage a surface temperature of the heat roller 48 by three-stage control.

Figure 3:
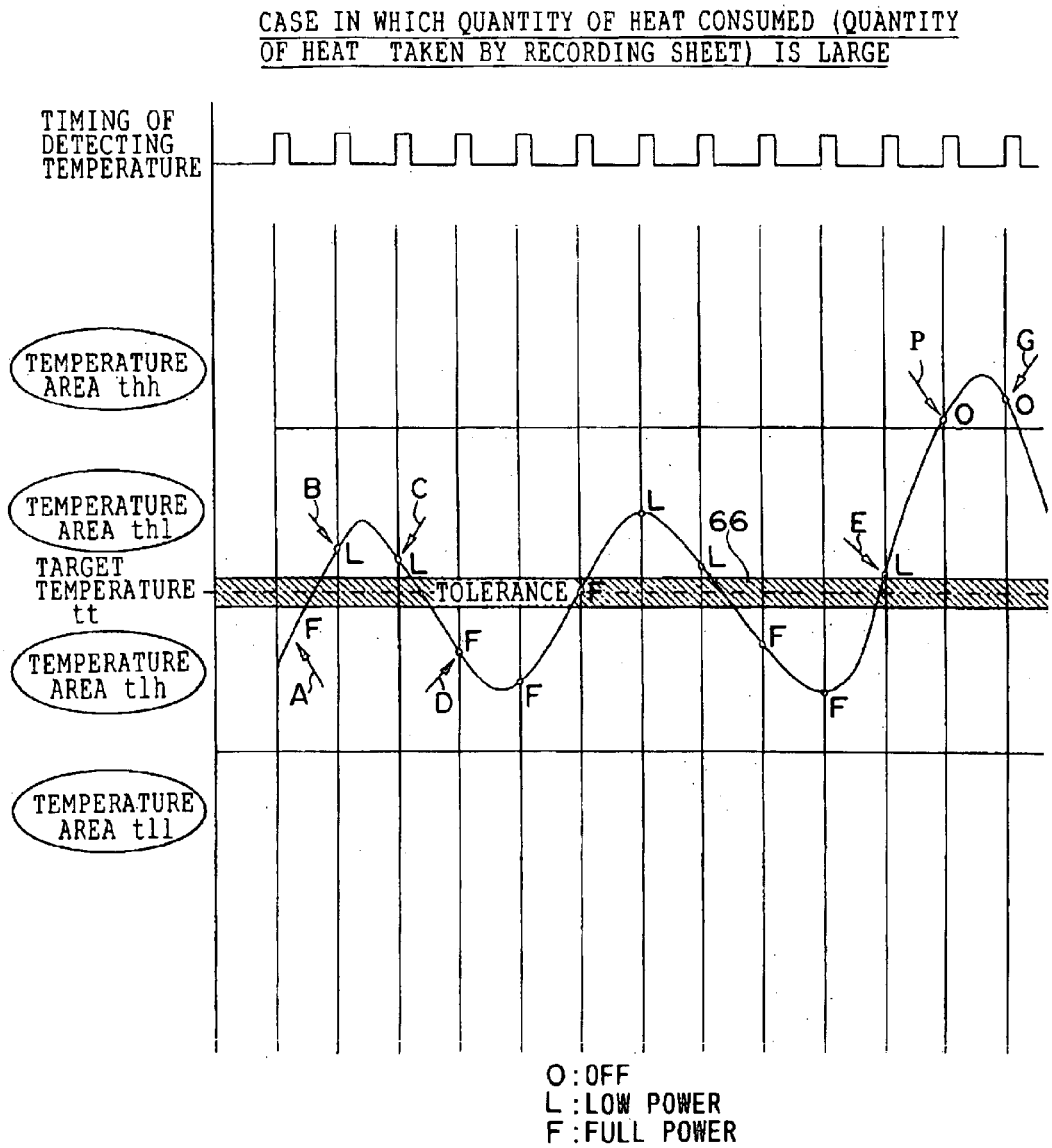
FIG. 3 is a distribution chart illustrating variation in temperature of the heat roller when a quantity of heat consumed is large in temperature control according to the embodiment of the invention.
Figure 4:
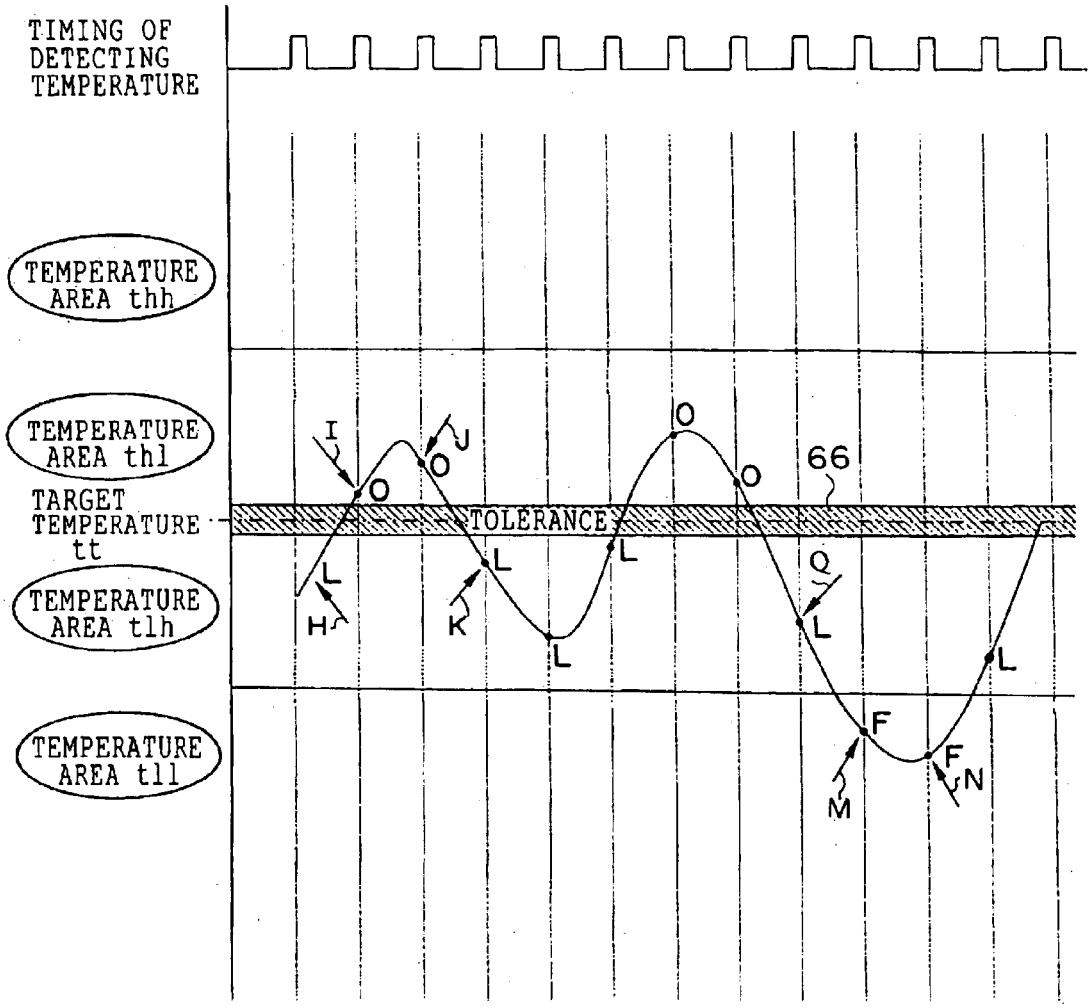
FIG. 4 is a distribution chart illustrating variation in temperature of the heat roller when a quantity of heat consumed is small in the temperature control according to the embodiment of the invention.

FIGS. 3 and 4 show patterns for controlling switching of the contact 58C of the switching circuit 58 on a basis of the temperature on the surface of the heat roller 48.

According to this embodiment, two temperature areas thh and thl (non-target temperature areas) are provided at a higher temperature side of the target temperature tt and two temperature areas tlh and tll (non-target temperature areas) are provided at a lower temperature side of the target temperature tt with the target temperature tt at the middle of them. The target temperature tt is provided with a predetermined tolerance 66. The target temperature tt and the tolerance 66 structure a target temperature area. Thus, temperature areas exceeding the upper limit level of the tolerance 66 are referred to as the temperature areas at the higher temperature side. On the other hand, temperature areas exceeding the lower limit of the tolerance 66 are referred to as temperature areas at the lower temperature side. The tolerance 66 serves as a hysteresis for reducing frequent temperature control (on/off) performed by temperature variation near the boundary of the temperature areas.

When a surface temperature t of the heat roller 48 detected by the temperature sensor 62 is the target temperature tt or within the tolerance 66, the power stage that has been used at that time is maintained.

When the surface temperature t of the heat roller 48 is within the temperature area thh which is at the higher temperature side of the target temperature tt and apart from the target temperature tt, every time the temperature sensor 62 detects a temperature, the power stage is decreased by one stage. When the surface temperature t of the heat roller 48 is within the temperature area tll which is at the lower temperature side of the target temperature tt and apart from the target temperature tt, every time the temperature sensor 62 detects a temperature, the power stage is increased by one stage.

When the surface temperature t of the heat roller 48 is within the temperature area tlh which is at the lower temperature side of the target temperature tt and near to the target temperature tt, control is performed as follows. Namely, when the surface temperature t has passed through a temperature area other than the temperature area tlh and the tolerance 66 (including the target temperature tt) and then reaches the temperature area tlh for the first time, the power stage is increased by one stage. Thereafter, while the temperature area tlh is being maintained, the power stage is not increased. For switching the power stage, when it has been in an OFF state, the power stage is switched to a LOW POWER stage (the contact 58C is switched from the third contact 58E to the second contact 58D). When it has been in a LOW POWER state, the power stage is switched to a FULL POWER state (the contact 58C is switched from the third contact 58D to the first contact 58A). When it has been in a full power state, such state is maintained.

When the surface temperature t of the heat roller 48 is within the temperature area thl which is at the higher temperature side of the target temperature tt and near to the target temperature tt, the same control is performed. Namely, when the surface temperature t has passed through a temperature area other than the temperature area thl and the tolerance 66 (including the target temperature tt) and then reaches the temperature area thl for the first time, the power stage is decreased by one stage. Thereafter, while the temperature area thl is being maintained, the power stage is not decreased.

By the above-described control being performed, the power stage is not proceeded from the OFF state directly to the FULL POWER state. Thus, a rush current can be suppressed.

An original object of the heat roller 48 is to heat the recording material 26. For this reason, a quantity of heat taken by the recording material 26 in a unit time is varied depending on a size, a thickness and a type of the recording material 26 and on whether the heat roller 48 is in a standby state or in a running state. Namely, the larger size of the recording material 26, the larger a quantity of heat taken by the recording material 26 becomes. As a result, the temperature of the heat roller 48 is rapidly decreased.

According to this embodiment, even if a rate of change in temperature on the surface of the heat roller 48 due to the recording material 26 varies, an actual surface temperature t of the heat roller 48 is controlled so as to be converged into the target temperature tt or a vicinity of the tolerance 66 because the power stage is switched by one stage in each of the temperature areas.

An operation of this embodiment will be described hereinafter.

During the image forming device 10 being operated, temperature control is performed in the heat roller 48 by on-off controlling the halogen lamps 54 in order to maintain the target temperature tt. At this time, in addition to the main lamp 54A, the sub-lamp 54B which is added in order to eliminate a flicker is used. As a result, temperature control for reducing generation of flicker caused by on-off control of the halogen lamps 54 can be performed.

When the image forming device 10 starts to be operated, in order to rapidly increase the temperature on the surface of the heat roller 48, the halogen lamps 54 must be lighted at full power from its OFF state. When the halogen lamps 54 are lighted at full power from its OFF state, however, a rush current becomes large, resulting in generation of flicker.

According to this embodiment, however, three power stages are changed by one stage. For this reason, when the image forming device 10 starts to be operated, the power can be increased in stages from OFF via LOW POWER to FULL POWER.

Figure 5:
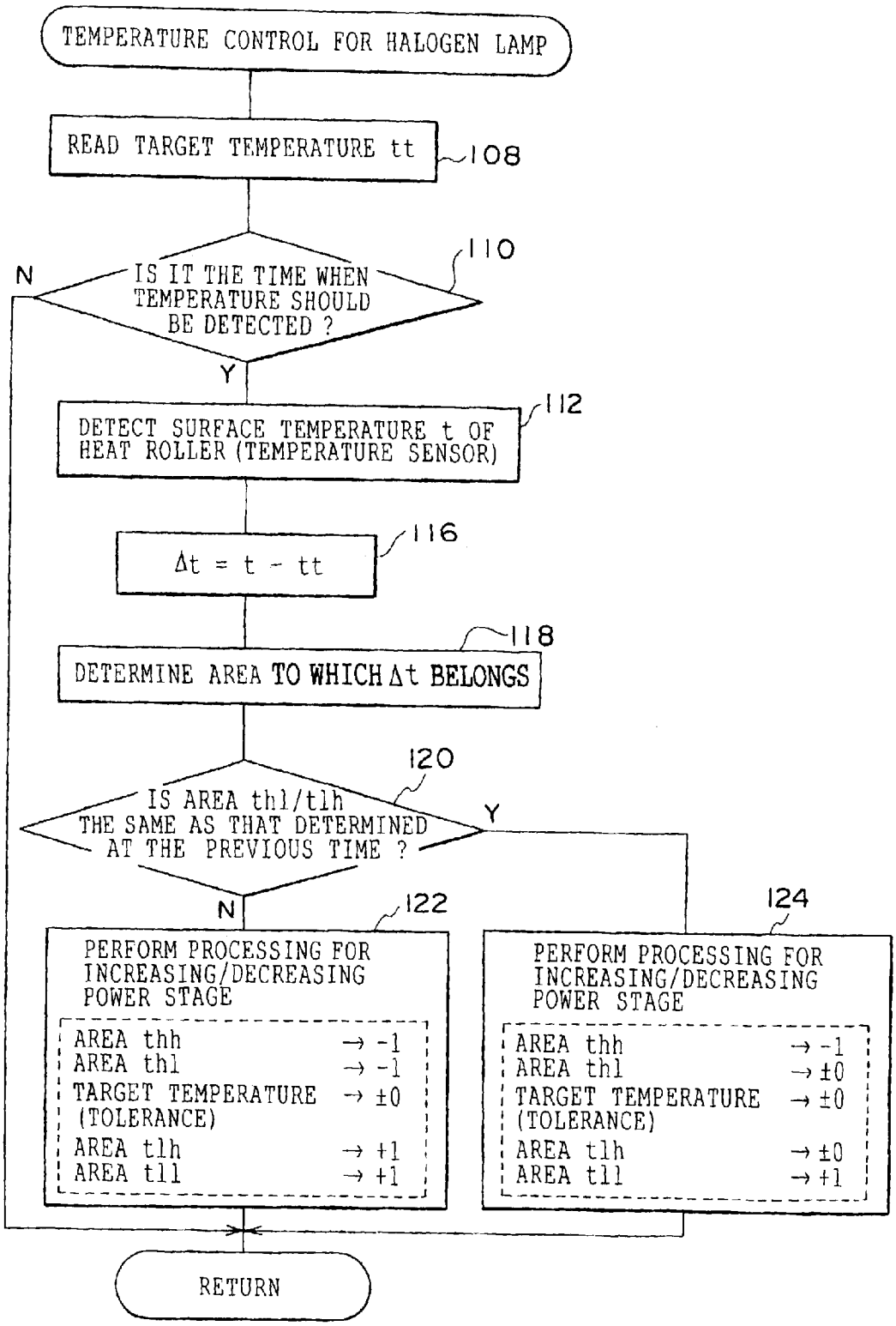
FIG. 5 is a flowchart illustrating a routine for controlling the temperature of halogen lamps.

A routine for controlling temperature of halogen lamp will be described hereinafter with reference to a flowchart shown in FIG. 5.

Firstly in step 108, the target temperature tt is read. Then, it is determined in step 110 whether or not it is the time when the surface temperature of the heat roller 48 should be detected. If the answer to the determination in step 110 is negative, it is determined that it is not the time when the temperature should be detected and this routine is not carried out. If the answer to the determination in step 110 is affirmed, it is determined that it is the time when the surface temperature of the heat roller 48 should be detected, and then the process proceeds to step 112. In step 112, the surface temperature t of the heat roller 48 is detected by the temperature sensor 62 and then the process proceeds to step 116.

In step 116, the difference At between a detected temperature t and the target temperature tt read in step 108 is calculated.

In step 118, it is determined, on a basis of the calculated difference Δt, to which temperature area Δt belongs (among four types of the temperature areas thh, thl, tlh and tll (except for the target temperature area (i.e., the target temperature tt and the tolerance 66))). Then, the process proceeds to step 120.

In step 120, if the determined temperature area is the temperature thl or tlh, it is determined whether or not the surface temperature has reached this determined temperature area for the first time after passing through a temperature area other than this determined temperature area and the target temperature area.

If it is determined in step 120 that, when the determined temperature area is the temperature area thl or tlh, the surface temperature has passed through a temperature area other than this determined temperature area and the target temperature area and then reaches this determined temperature area for the first time, the process proceeds to step 122. Then, increasing/decreasing of the power stage which is set for each of the temperature areas is performed. The power stage is increased/decreased in step 122 according to an increasing/decreasing pattern used when the surface temperature is moved from other temperature areas to this determined temperature area for the first time.

The surface temperature of the heat roller 48 may remain within the same temperature area depending on its variation. If the power stage is increased/decreased repeatedly as in the above-described case, especially when the surface temperature is still within the temperature area thl or tlh, an amplitude of power tends to be large. If it is determined in step 120 that the determined temperature area is the temperature area thl or tlh and it is not the first time that the surface temperature has entered this determined temperature area after passing through a temperature area other than this determined temperature area and the target temperature area, the process proceeds to step 124. Then, a control is performed according to power stage increasing/decreasing pattern that increasing/decreasing of the power stage is passed (cancelled) in the temperature area thl or tlh.

In step 120, if the determined temperature area is thh or tll, the process proceeds to step 122 or 124.

In step 122 or 124, the power stage in the temperature area thh is decreased by 1. In order to suppress an overshoot, however, the power stage may be directly changed from a FULL POWER state to an OFF state.

FIG. 3 shows an example of pattern of variation in temperature of the heat roller 48 when a quantity of heat taken by the recording material 26 is large.

Referring to FIG. 3, the heat roller 48 is first heated at FULL POWER in the temperature area tlh and thus the surface temperature of the heat roller 48 tends to be increased (see the arrow A shown in FIG. 3). The surface temperature exceeds the target temperature tt (and its tolerance 66) and reaches the temperature area thl. Since the power stage is decreased by 1 in the temperature area thl, the power control is switched to LOW POWER (see the arrow B shown in FIG. 3). Here, since a quantity of heat taken by the recording material 26 is large, the quantity of heat taken exceeds a quantity of heating in a LOW POWER state and thus the surface temperature tends to be decreased.

If the surface temperature is still within the same temperature area thl at a time of next detection for temperature, the present state of power control (LOW POWER) is maintained although the power stage is usually decreased by 1 in this temperature area (see the arrow C shown in FIG. 3). Thus, an abrupt decrease in temperature can be prevented.

Then, when the surface temperature is decreased below the target temperature tt (and its tolerance 66) and reaches the temperature area tlh, the power control is switched to FULL POWER because the power stage is increased by 1 in the temperature area tlh (see the arrow D shown in FIG. 3).

When the treatment for the recording material 26 stops while the above-described state is repeated, a quantity of heat taken becomes small. For this reason, even in a LOW POWER state in the temperature area thl (see the arrow E shown in FIG. 3), the surface temperature continues to be increased and then reaches the temperature area thh. Since the power stage is decreased by 1 in the temperature area thh, the power control is switched to an OFF state (see the arrow P shown in FIG. 3). Even if the power control is in an OFF state, the surface temperature may be increased a little by remaining heat. As a result, however, the surface temperature tends to be decreased. When the surface temperature is in the temperature area thh at a time of next detection for temperature, the OFF state is maintained (see the arrow G shown in FIG. 3) and then the surface temperature is decreased toward the target temperature tt.

FIG. 4 shows an example of pattern of variation in temperature of the heat roller 48 when a quantity of heat taken by the recording material 26 is small.

Referring to FIG. 4, the heat roller 48 is first heated at LOW POWER in the temperature area tlh and thus the surface temperature of the heat roller 48 tends to be increased (see the arrow H shown in FIG. 4). When the surface temperature exceeds the target temperature tt (and its tolerance 66) and reaches the temperature area thl, the power control is switched to an OFF state because the power stage is decreased by 1 in the temperature area thl (see the arrow I shown in FIG. 4). Here, since a quantity of heat taken by the recording material 26 is small, the surface temperature is increased a little but tends to be decreased thereafter.

When the surface temperature is still in the temperature area thl at a time of next detection for temperature, the power control has already been in an OFF state and thus this OFF state is maintained although the power stage is usually decreased by 1 in the temperature area thl (see the arrow J shown in FIG. 4).

Then, when the surface temperature is decreased below the target temperature tt (and its tolerance 66) and reaches the temperature area tlh, the power control is switched to a LOW POWER because the power stage is increased by 1 in the temperature area tlh (see the arrow K shown in FIG. 4).

When the recording material 26 is successively treated while the above-described state being repeated, a quantity of heat taken becomes unexpectedly large. For this reason, even when the power control is switched to a LOW POWER in the temperature area thl (see the arrow O shown in FIG. 4), the surface temperature continues to be even further decreased and thus reaches the temperature area tll. Since the power stage is increased by 1 in the temperature area tll, the power control is switched to a FULL POWER (see the arrow M shown in FIG. 4). Although the surface temperature may be decreased a little even in the FULL POWER state due to delayed response, the surface temperature tends to be increased. Even if the surface temperature is still in the temperature area tll at a time of next detection for temperature, the FULL POWER state is maintained (see the arrow N shown in FIG. 4) and the surface temperature is increased toward the target temperature tt.

As described above, according to this embodiment, two temperature areas are set at the higher temperature side of the target temperature tt and two temperature areas are set at the lower temperature side of the target temperature tt with the target temperature tt at the middle of them. Further, the power stage is decreased by 1 in the temperature areas thl and thh at the higher temperature side. The power stage is increased by 1 in the temperature areas tlh and tll at the lower temperature side. Thus, the power control is performed so that the power stage is not extremely increased/decreased, i.e., the power stage is not momentarily varied by two stages. As a result, a current value is varied little and generation of flicker caused by on-off control can be reduced.

Further, because of such power control in stages, the surface temperature is controlled so as to be always converged into the target temperature tt. For this reason, problems in a control method that the power stage is absolutely determined simply by a temperature area, a converged position (a converged temperature) is varied depending on a rate of change in a quantity of heat taken by the recording material 26 can be solved.

In the temperature areas thl and tlh, the power stage is increased/decreased conditionally. Namely, if a temperature area is near to the target temperature area, the power stage is maintained except for the case in which the surface temperature has passed through a temperature area other than this near temperature area and the target temperature area and then reaches this near temperature area for the first time. As a result, an amplitude of power at a time of the power control can be suppressed.

Figure 6:
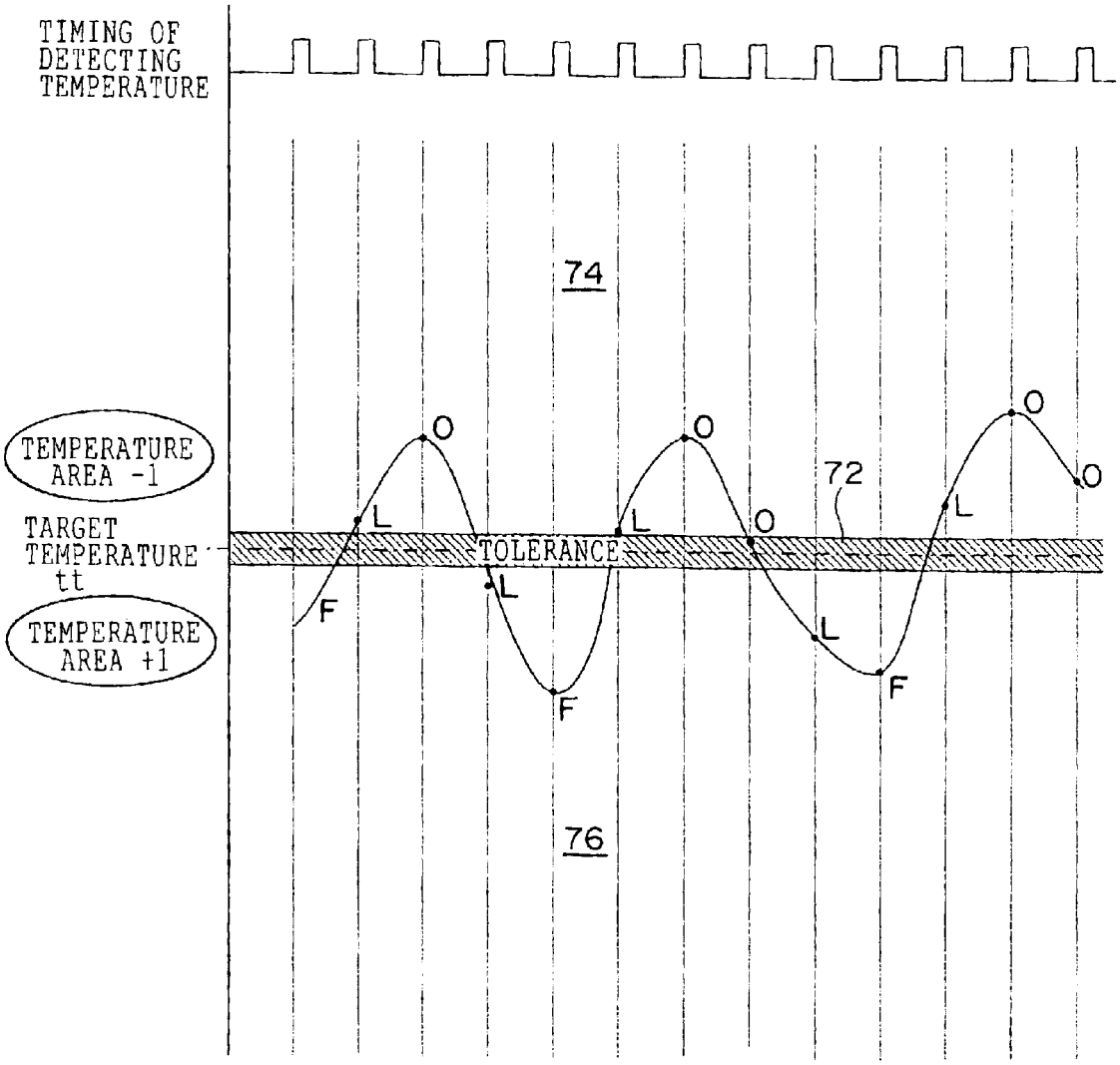
FIG. 6 is a distribution chart illustrating variation in temperature of the heat roller in simple temperature control.
Figure 7:
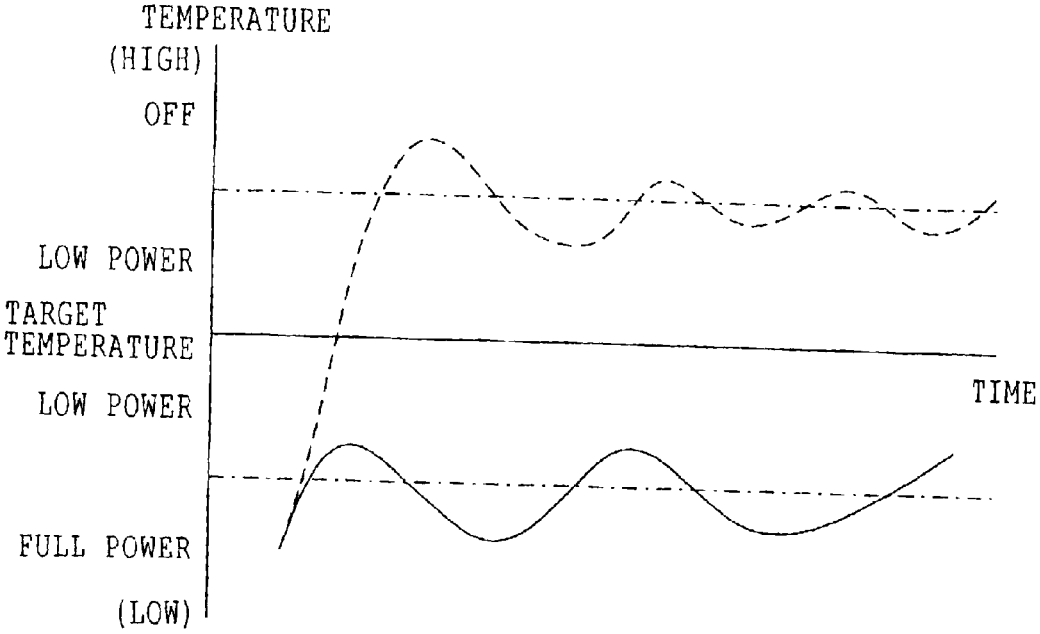
FIG. 7 is a distribution chart illustrating variation in temperature of the heat roller when a power stage is uniquely set for each temperature area.

According to this embodiment, two temperature areas are respectively provided above and below the target temperature area serving as a boundary. Here, minimum and simple temperature control will be considered. Namely, as shown in FIG. 6, a temperature area 74 in which the power stage is decreased by 1 is provided at a higher temperature side of tolerance 72 of a target temperature tt and a temperature area 76 in which the power stage is increased by 1 is provided at a lower temperature side of the tolerance 72 with the tolerance 72 at the middle of them. In this case, a rush current can be suppressed but it is difficult to conform a standard for flicker. Thus, it is effective to provide two or more temperature areas respectively above and below a target temperature area serving as a boundary in order to thoroughly accomplish an object of the invention.

According to this embodiment, two halogen lamps 54 (main lamp 54A and sub-lamp 54B) are provided in serial within the heat roller 48. In order to improve the precision of temperature control, the heat roller 48 may be divided in three sections along an axial direction. Then, two independent halogen lamps 54 (main lamp 54A and sub-lamp 54B) may be provided in serial within side sections and a central section of the heat roller 48, respectively. In this case, heat easily escapes from a shaft of rotation and the like at the side sections of the heat roller 48. Thus, it is preferable that the rated power of each pair of halogen lamps 54 in the side sections of the heat roller 48 is larger than that of the pair of halogen lamps 54 at the central section of the heat roller 48. By shifting phases of on-off timings for the pairs of halogen lamps 54, it is possible to prevent the pairs of halogen lamps 54 from turning on (or off) at the same time. As a result, generation of rush current can be reduced.

As described above, the heat roller 48 is divided into three sections along its axial direction and the divided sections are independently subjected to temperature control. Thus, generally uniform temperature can be maintained over an entire circumferential surface of the heat roller 48.

What is claimed is:

1. A fusing device for use with an image forming device, which supplies toner to a latent image that is obtained by being exposed to light on a charged image carrier to form the latent image into an image and transfers a resultant toner image from the image carrier to a recording material, and for fixing the toner image on the recording material by applying a predetermined quantity of heat to the recording material, the fusing device comprising:

a heat roller which forms a portion of a conveyance path for the recording material and nips the recording material;

a plurality of lamps which are accommodated within the heat roller and are connected in serial with each other and serve as heat sources;

a switching component which classifies the plurality of lamps into at least a main lamp group and a sub-lamp group and is able to switch between application of electricity to the main lamp group and the sub-lamp group, application of electricity to only the main lamp group and application of electricity to neither the main lamp group nor the sub-lamp group; and a temperature control component which controls a temperature of the heat roller by controlling on or off switching of the plurality of lamps to control the power stage of the plurality of lamps with at least stages of off, low power and full power.

2. A fusing device according to claim 1 further comprising a detection component which detects the temperature of the heat roller, wherein a plurality of temperature areas for the heat roller are set and a number of power stage to be increased/decreased is set for each of the temperature areas, and the temperature control component increases/decreases, as necessary, the power stage by the number of power stage to be increased/decreased, which is set for the temperature area to which the temperature of the heat roller belongs, when the temperature of the heat roller is detected by the detection component.

3. A fusing device according to claim 2, wherein a target temperature area for the heat roller and non-target temperature areas at a higher temperature side of the target temperature area and at a lower temperature side of the target temperature area are set as the temperature areas.

4. A fusing device according to claim 3, wherein when the temperature area to which the temperature of the heat roller belongs is a non-target temperature area adjacent to the target temperature area, the temperature control component increases/decreases the power stage only in a case in which the temperature of the heat roller has passed through a temperature area other than said adjacent non-target temperature area and the target temperature area and then enters said adjacent non-target temperature area for the first time.

5. A fusing device according to claim 3, wherein when the temperature area to which the temperature of the heat roller belongs is a non-target temperature area near to the target temperature area, the temperature control component increases/decreases the power stage only in a case in which the temperature of the heat roller has passed through a temperature area other than said near non-target temperature area and the temperature area, which is adjacent to said near non-target temperature area and in which the number of power stage to be increased/decreased is set to 0, and then enters said near non target temperature area for the first time.

6. A heat generating devices comprising:

a heat generating member which includes a plurality of heat sources connected in series with each other and generates heat by application of electricity to at least one of the heat sources;

a heat generation control component which separately controls on or off switching of the application of electricity to each of the heat sources and makes the heat generating member generate heat in at least three power stages.

7. A heat generating device according to claim 6, wherein the heat generating member generates heat and heats a heated member.

8. An image forming device comprising: the heat generating device according to claim 7, wherein the image forming device is for supplying toner to a latent image that was obtained by being exposed to light on a charged image carrier to form toner image onto the image carrier and for transferring the toner image from the image carrier to the heated member, wherein the toner image is fixed onto the heated member by the heat generating member heating the heated member.

9. A heat generating device according to claim 6 further comprising a detection component which detects a temperature of the heat generating member, wherein a plurality of temperature areas are set for the heat generating member and a number of power stage to be increased/decreased is set for each of the temperature areas, and when the temperature of the heat generating member is detected by the detection component, the heat generation control component increases/decreases, as necessary, the power stage by the number of power stage to be increased/decreased, which is set for the temperature area to which the temperature of the heat generating member belongs.

10. A heat generating device according to claim 9, wherein a target temperature area for the heat generating member and non-target temperature areas at a higher temperature side of the target temperature area and at a lower temperature side of the target temperature area are set as the temperature areas.

11. A heat generating device according to claim 10, wherein a plurality of the non-target temperature areas are set at the higher temperature side of the target temperature area and the lower temperature side of the target temperature, respectively.

12. A heat generating device according to claim 10, wherein the number of power stage to be decreased/increased is set to 0 in the target temperature area, the number of power stage to be decreased/increased is set to −1 in the non-target temperature area at the higher temperature side of the target temperature area and the number of power stage to be decreased/increased is set to +1 in the non-target temperature area at the lower temperature side of the target temperature area.

13. A heat generating device according to claim 10, wherein when the temperature area to which the temperature of the heat generating member belongs is a non-target temperature area adjacent to the target temperature area, the heat generation control component increases/decreases the power stage only in a case in which the temperature of the heat generating member has passed through a temperature area other than said adjacent non-target temperature area and the target temperature area and then enters said adjacent non-target temperature area for the first time.

14. A heat generating device according to claim 10, wherein when the temperature area to which the temperature of the heat generating member belongs is a non-target temperature area near to the target temperature area, the heat generation control component increases/decreases the power stage only in a case in which the temperature of the heat generating member has passed through a temperature area other than said near non-target temperature area and the temperature area, which is adjacent to said near non-target temperature area and in which the number of power stage to be increased/decreased is set to 0, and then enters said near non-target temperature area for the first time.

15. A temperature control method for controlling a temperature of a heat generating member by making the heat generating member generate heat in a plurality of power stages, the temperature control method comprising the steps of:

setting a plurality of temperature areas for the heat generating member and setting a number of power stage to be increased/decreased for each of the temperature areas;

detecting the temperature of the heat generating member; and increasing/decreasing, as necessary, the power stage by the number of power stage to be increased/decreased, which is set for the temperature area to which the temperature of the heat generating member belongs.

16. A temperature control method according to claim 15, wherein a target temperature area for the heat generating member and non-target temperature areas at a higher temperature side of the target temperature area and at a lower temperature side of the target temperature area are set as the temperature areas.

17. A temperature control method according to claim 16, wherein a plurality of the non-target temperature areas are set at the higher temperature side of the target temperature area and the lower temperature side of the target temperature area, respectively.

18. A temperature control method according to claim 16, wherein the number of power stage to be decreased/increased is set to 0 in the target temperature area, the number of power stage to be decreased/increased is set to −1 in the non-target temperature area at the higher temperature side of the target temperature area and the number of power stage to be decreased/increased is set to +1 in the non-target temperature area at the lower temperature side of the target temperature area.

19. A temperature control method according to claim 16, wherein when the temperature area to which the temperature of the heat generating member belongs is a non-target temperature area adjacent to the target temperature area, the power stage is increased/decreased only in a case in which the temperature of the heat generating member has passed through a temperature area other than said adjacent non-target temperature area and the target temperature area and then enters said adjacent non-target temperature area for the first time.

20. A temperature control method according to claim 16, wherein when the temperature area to which the temperature of the heat generating member belongs is a non-target temperature area near to the target temperature area, the power stage is increased/decreased only in a case in which the temperature of the heat generating member has passed through a temperature area other than said near non-target temperature area and the temperature area, which is adjacent to said near non-target temperature area and in which the number of power stage to be increased/decreased is set to 0, and then enters said near non-target temperature area for the first time.

* * * * *